United States Patent [19]

Makous

[11] Patent Number: 5,050,836

[45] Date of Patent: Sep. 24, 1991

[54] SECURITY DEVICE FOR PORTABLE EQUIPMENT

[76] Inventor: Joseph M. Makous, 1617 E. Darby Rd., Suite 203, Havertown, Pa. 19083

[21] Appl. No.: 541,557

[22] Filed: Jun. 21, 1990

[51] Int. Cl.[5] ..... E05B 73/00

[52] U.S. Cl. ..... 248/553; 70/58; 410/101

[58] Field of Search ..... 248/552, 551, 553, 683, 248/680, 205.3, 289.1, 291, 500, 506, 499, 918; 70/58, 18, 30, 49; 403/165; 410/101, 102, 106

[56] References Cited

U.S. PATENT DOCUMENTS

| | | | |
|---|---|---|---|
| 2,480,662 | 8/1949 | McKinzie | 403/165 |
| 2,729,418 | 1/1956 | Maynard | 410/102 |
| 3,664,163 | 5/1972 | Foote | 248/553 |
| 3,727,934 | 4/1973 | Averbook . | |
| 3,866,873 | 2/1975 | Bohli . | |
| 4,065,083 | 12/1977 | Gassaway . | |
| 4,691,891 | 9/1987 | Dionne . | |
| 4,733,840 | 3/1988 | D'Amore . | |
| 4,826,193 | 5/1989 | Davis | 410/106 |
| 4,842,912 | 6/1989 | Hutter, III . | |
| 4,979,382 | 12/1990 | Perry | 70/232 |

FOREIGN PATENT DOCUMENTS

| | | | |
|---|---|---|---|
| 987121 | 4/1976 | Canada | 70/58 |

OTHER PUBLICATIONS

Kablit Security System Catalog, pp. 7, 93, 1988.

*Primary Examiner*—Ramon O. Ramirez
*Assistant Examiner*—Robert A. Olson

[57] ABSTRACT

The security device for portable equipment includes a rigid base plate, and a resilient elastomeric base pad permanently secured to the base plate for providing a flexible but strong adhesive bond to the surface of the portable equipment or the anchor fixture. A rotatable attachment fitting is connected to the base plate, and includes a rotatable shaft having a means for receiving the security cable that is preferably a transverse aperture through the shaft, and that include a means for securing the cable to the shaft, such as by a set screw in the shaft.

13 Claims, 2 Drawing Sheets

FIG. 1
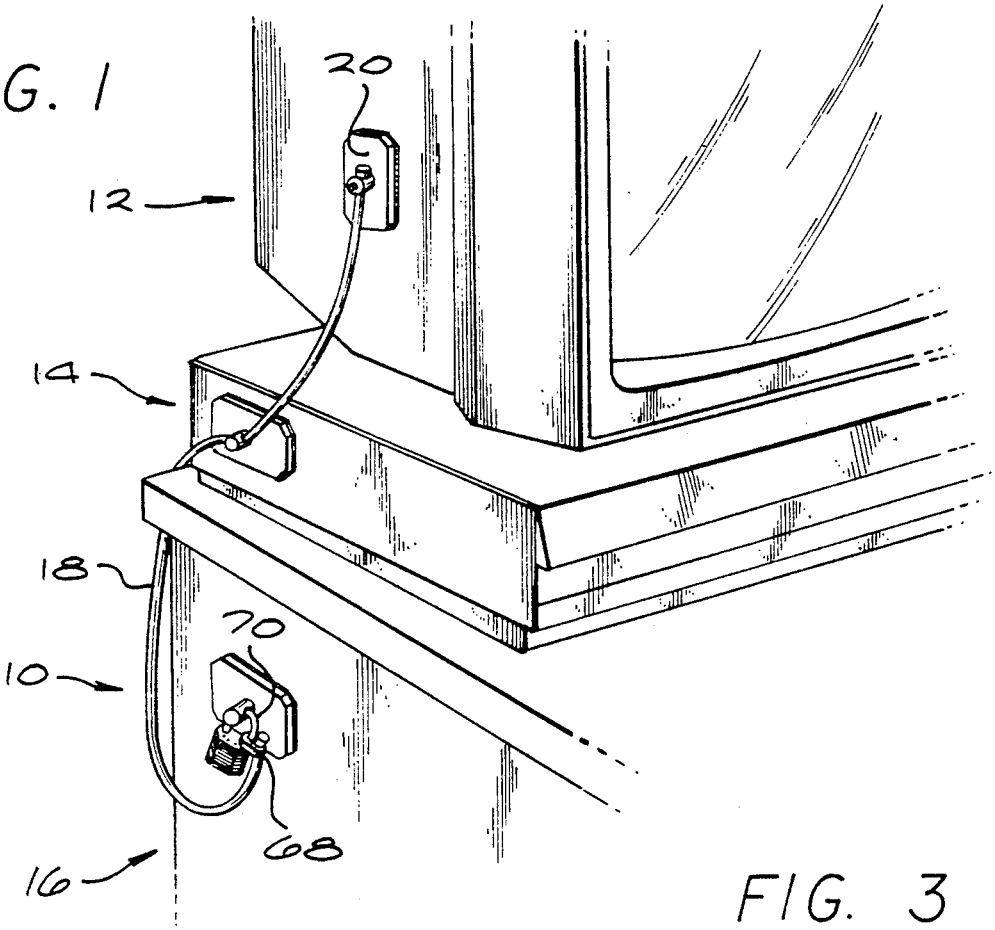
FIG. 3
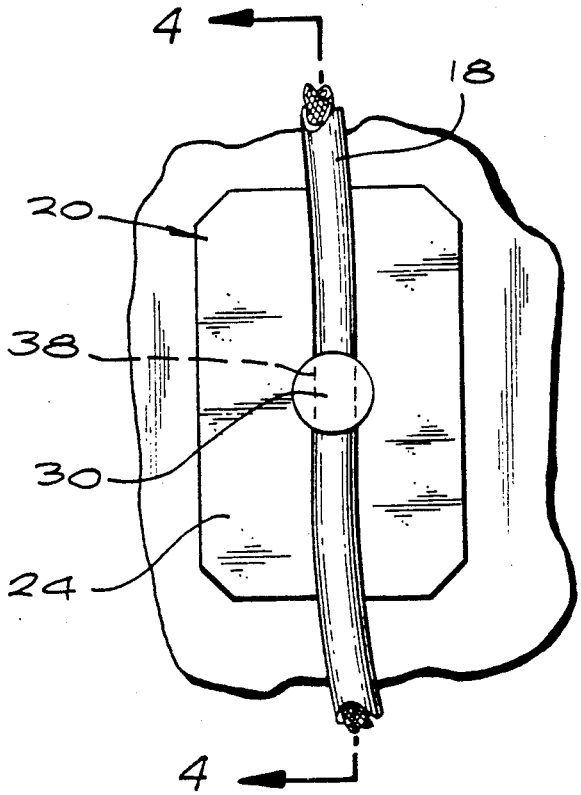
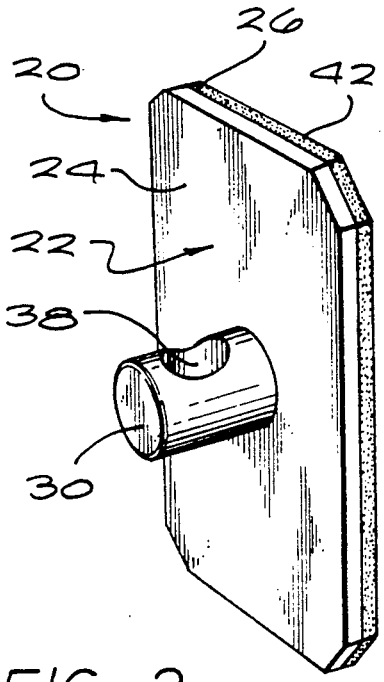
FIG. 2

FIG. 4
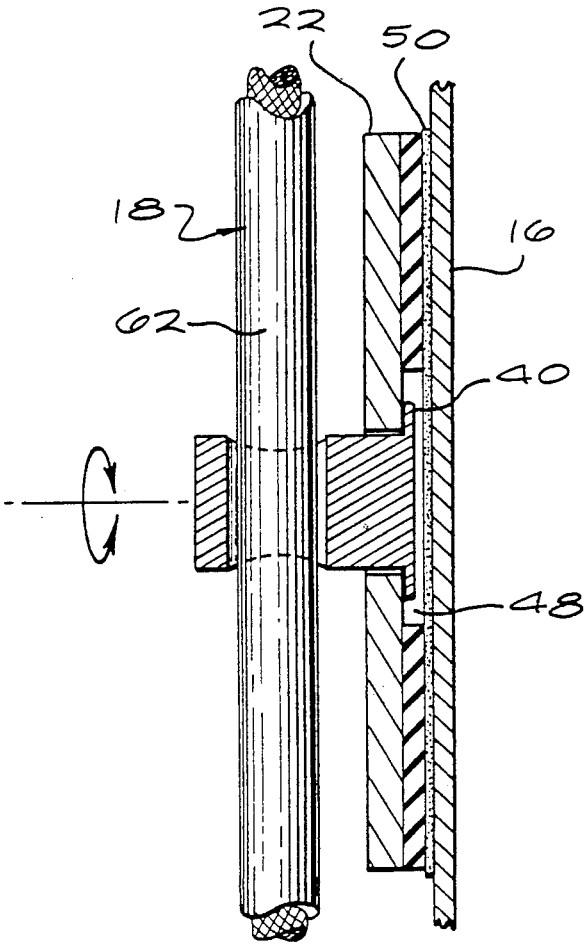
FIG. 7
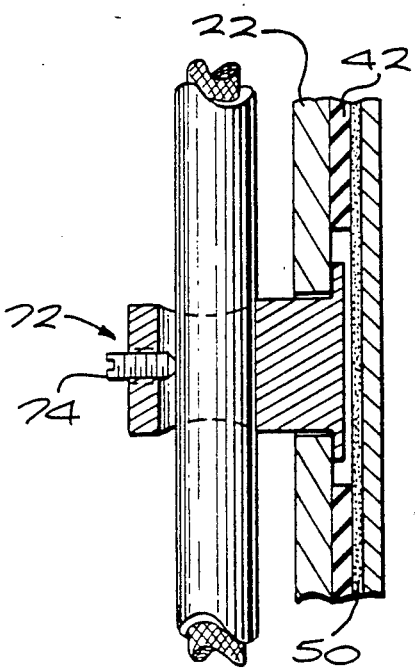
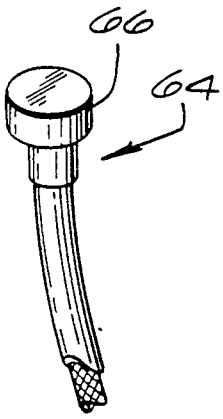
FIG. 6
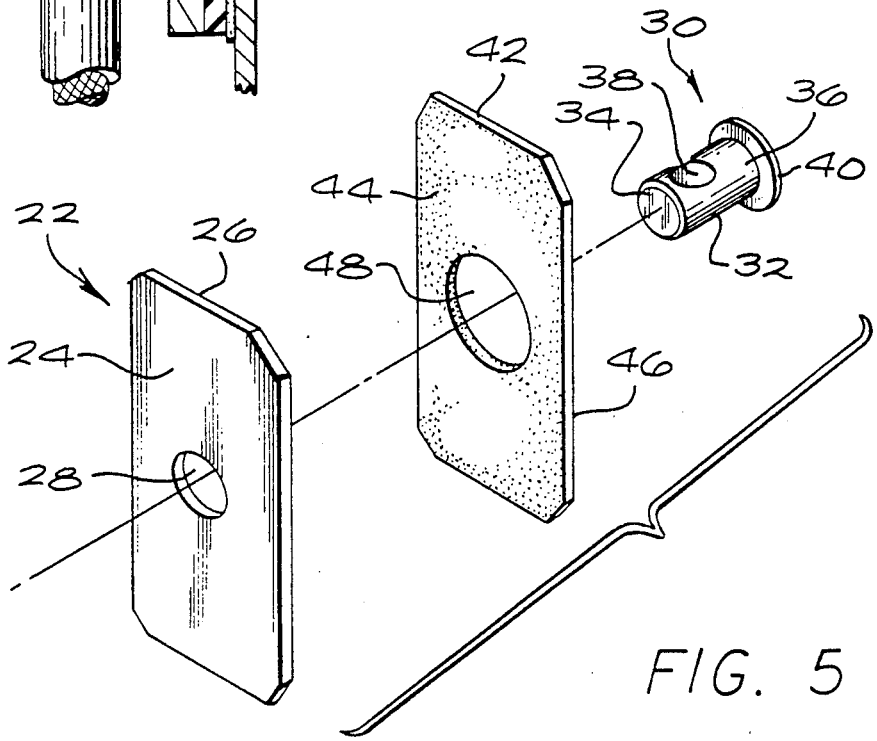
FIG. 5

SECURITY DEVICE FOR PORTABLE EQUIPMENT

BACKGROUND OF THE INVENTION

1. Field of the Invention

This invention generally relates to anti-theft devices for portable equipment, and more particularly relates to a cable attachment device which may be used in combination with an anti-theft cable system for connecting one or more pieces of portable equipment to an anchor fixture.

2. Description of Related Art

As portable desktop computer equipment has become increasingly powerful, the monetary value and importance to businesses and institutions using them has also increased. Other portable equipment, such as video cassette recorders, facsimile machines, and printers have also found many significant uses in businesses and institutions. Since such portable equipment can frequently be simply picked up and carried away in a matter of a few seconds, theft of portable equipment remains a serious problem.

Various types of anti-theft systems for tying down and connecting such portable equipment with heavy duty security cables have been developed. Such cable security systems typically include a steel cable and various attachment hardware to anchor the portable equipment to a work station which is relatively stationary. Typically, a cable attachment fixture is mounted to a portion of the surface of the equipment and to the surface of a work station by screw mounted fittings and/or adhesive plates, so as to not void manufacturer's warranties. Screw mounted fittings are typically attached to the equipment by using existing equipment screws. The security cable system is then attached to the screw mounted fitting on the equipment. Unfortunately, such original equipment screws are generally not very large or strong, and can frequently be quickly snapped off with a moderate use of force, resulting in a separation of the fitting from the equipment, and failure of the security system.

Cable attachment devices may also be mounted by adhesive to the portable equipment and to anchor fixtures. One prior art security device includes a metal base plate containing a cable attachment ring which is nonrotatably fixed to a center portion of the base plate. The cable attachment device is mounted to the equipment by a double-stick adhesive pad to provide a slightly flexible bond, which has been found to be superior to the relatively vulnerable, brittle bond which forms between two rigid surfaces.

Double-sided adhesive tape made from a spongy adhesive saturated material is commonly used to provide flexibility of an adhesive bond of a cable attachment mounting plate. However, in order to provide a strong enough bond so that the adhesive mount is not the weakest link in the security system, the surface area required for the adhesive plate may be as much as 33 square inches, which is frequently not available on many modern business machines. Such spongy, adhesive material is also easily cut, such as with a thin piano wire. One type of adhesive mount for a cable attachment device includes a number of cylindrical, cut resistant bodies extending from the equipment surface to the base plate of the attachment device. The cut resistant bodies are also secured to the equipment or anchor surface by adhesive, and have an enlarged conical base end to further prevent a cutting wire from sliding underneath the cut-resistant body. Other alternatives for preventing the relatively spongy adhesive material from being cut are nails or staples provided around the perimeter of the mounting plate.

There remains a need for a security cable mounting system which is sufficiently strong and relatively invulnerable to attack such that the security cable itself becomes the weakest part of the security system, even when used with portable equipment having as little as five square inches of available mounting surface.

It has been found that security cable mounting plates mounted with double sided adhesive material occasionally fall off of the equipment or anchor surface, when used in combination with a heavy duty cable. Such heavy cables can exert a substantial, constant pressure against the adhesive, resulting in an eventual failure of the adhesive. Stress on the adhesive can be exerted by the cable when the equipment that is secured by the cable is moved on the work surface, bending the cable, since a substantial amount of force can be generated by such a stiff, heavy duty cable. It would therefore be desirable to provide a cable attachment fitting which can be mounted with a relatively flexible, strong adhesive bond, and with a cable attachment fitting that is allowed to rotate freely relative to the plate and mounting surface to reduce stresses on the cable attachment mount.

SUMMARY OF THE INVENTION

Briefly, and in general terms, the present invention provides a new and improved cable attachment device for a security system for portable equipment, embodying a novel apparatus for adhesively mounting the attachment device to the surface of the equipment or to an anchor surface and providing a rotatable connector for receiving a security cable.

The present invention is generally directed to an improved security device for portable equipment which includes a rigid base plate, and a resilient elastomeric base pad permanently secured to the base plate for providing a flexible but strong adhesive bond to the surface of the portable equipment or the anchor fixture. A rotatable attachment fitting is connected through the base plate, and includes a rotatable shaft having a means for receiving the security cable that is preferably a transverse aperture through the shaft, and that may also include a means for securing the cable to the shaft, such as by a set screw in the shaft.

Although adhesive security cable mounts are an attractive alternative to screw based mounting, the strength of such adhesive bonds to the equipment surface or anchor surface is generally proportional to the adhesive surface area and rigidity of the base plate. Most attachment plates currently available are made from rigid materials, such as metal or hard plastic. However, it has been found that the bond created between two rigid surfaces, such as may occur when a flat steel plate is adhered directly to a rigid computer case, will be brittle and subject to failure if the attachment mounting is pried with a screw driver or other instrument worked under the edge of the plate. A better adhesive mount can be formed with a thin layer of a high density elastomer, such as rubber, sandwiched between the base plate and the equipment or anchor surface. The high density layer of elastomer is sufficiently resilient to provide a flexible, non-brittle bond, and can be bonded to both the base plate of the attachment fitting and the equipment or anchor surface with a strong, liquid adhesive, such as cyanoacrylate. Tests have shown that as little as five square inches of a high density rubber, such as neoprene, adhered to a rigid base plate and to the equipment case provides a virtually unremovable mount. Such an attachment base can be used on even the smallest machines.

Tests have shown that an adhesive tape with an acrylic foam type of pad mounting the base plate of an attachment fitting to a substrate has a tensile strength of approximately 120 psi, whereas a high density elastomer bonded with cyanoacrylate liquid adhesive has a tensile strength of approximately 4,000 psi. Failure of the high density elastomer itself will occur at approximately 800 psi before failure of the cyanoacrylate adhesive bond. Thus, with as little as five square inches of the high density elastomeric material, such as neoprene, the liquid cyanoacrylate adhesive bond of the attachment fitting to an equipment or anchor surface can be virtually indestructible.

Another problem which occurs in bonding a security cable attachment plate to a surface with the liquid cyanoacrylate adhesive is that a slight amount of flex in the attachment plate itself could enable one to apply a sufficient peel force on the plates to eventually pry the attachment plate loose. It was found that an attachment plate which was virtually flex free eliminated any potential for peeling of the attachment plate, so that removal of the plate would require destruction of the entire high density elastomer pad all at once. Thus, with a sufficiently rigid, flex-free base plate, such as a ⅛ inch thick steel plate, for example, an attachment fitting having a resilient elastomeric base pad adhesively mounted to the surface of equipment or an anchor fixture can be substantially nonremovable.

These and other objects and advantages of the invention will become apparent from the following more detailed description, taken in conjunction with the accompanying drawings which illustrate the invention, by way of example.

BRIEF DESCRIPTION OF THE DRAWINGS

FIG. 1 is a perspective view of a security cable system utilizing the security device of the invention to secure portable equipment to an anchor fixture;

FIG. 2 is an enlarged perspective view of the security device of the invention shown in FIG. 1;

FIG. 3 is a top plan view of the security device mounted on a surface with a security cable passing therethrough;

FIG. 4 is a cross-sectional elevational view taken along 4—4 of FIG. 3;

FIG. 5 is an exploded view of the security device illustrated in FIG. 2;

FIG. 6 is an enlarged view of an end portion of a security cable; and

FIG. 7 is a perspective view of an alternative embodiment of the security device.

DESCRIPTION OF THE PREFERRED EMBODIMENT

Referring now to the drawings, and particularly to FIG. 1, a cable security system 10 is shown connecting portable equipment, which may be for example, a television or a monitor 12, and a desk top computer 14, which are connected to an anchor surface, such as a table 16, by a high strength security cable 18. Although a variety of security cables, locking bars, and locks may be used with the security device of the present invention, the security device 20 is particularly adapted to receive a high strength steel cable, since such a cable offers the combination of strength and flexibility, so that the cable security system may be used with a variety of equipment for which some degree of freedom of movement would be desirable.

The security device includes a base plate 22, preferably formed of a rigid material such as steel. The base plate is most preferably virtually flex free, to avoid the likelihood of peeling of the security device from the surface of the equipment or anchor fixture. When the base plate is made of steel, it has been found that a ⅛" steel plate is sufficiently rigid so as to be virtually flex free. Other materials, such as brass, other metals, rigid polymers, ceramics or other suitable materials may also be used if manufactured with a sufficiently rigid, flex free thickness. The base plate includes a first flat side 24, and a second flat side 26, and a generally circular aperture, preferably formed through the approximate center of the base plate, for receiving a rotatable attachment fitting 30.

Referring to FIGS. 2, 4 and 5, the attachment fitting includes a generally cylindrical shaft portion 32 having diameter slightly less than the diameter of the circular aperture through the base plate, to allow the shaft to rotate freely when it is inserted in the aperture. The shaft includes a first longitudinal end 34 and a second longitudinal end 36, with a transverse aperture 38 which is preferably approximately circular extending through the shaft, preferably approximately midway between the two ends of the shaft. The shaft also includes an enlarged end or flange 40 at the second longitudinal end 36, which has a diameter larger than the diameter of the central aperture through the base plate. The cylindrical shaft of the rotatable attachment fitting can therefore be inserted through the aperture of the base plate, but is prevented from passing completely through the base plate by the flange at the end of the shaft. The rotatable attachment fitting is also preferably made of steel, although other materials which are sufficiently strong may also be suitable.

The security device also includes a resilient elastomeric base pad, having a first side 44 and a second side 46, with a generally circular aperture 48 therethrough. The base pad is preferably shaped and dimensioned to conform to the shape of the base plate, and the aperture 48 in the base pad is placed so as to be aligned with the base plate aperture when the base plate and base pad are joined. The elastomeric base pad is preferably formed of a resilient rubber, such as neoprene, although other elastomers which are also firm but resilient, such as urethane or butyl rubber and the like, may also be suitable. The central aperture through the elastomeric base pad preferably has a diameter larger than the diameter of the flange at the end of the rotatable attachment fitting, and the enlarged end 40 of the shaft of the attachment fitting is preferably slightly thinner than the base pad, so as not to interfere with adhesion of the base pad to the equipment surface, and to allow the attachment fitting to rotate freely after the upper or first side of the elastomeric base pad is permanently secured to the lower, second side of the base plate, such as by liquid cyanoacrylate adhesive. The lower, second side of the elastomeric base pad is adapted to be mounted to the surface of the portable equipment or the anchor fixture by adhesive, such as liquid cyanoacrylate adhesive. It has been found that a security device having a base plate and elastomeric base pad approximately 2" by 3" with a ⅛" steel base plate and an approximately 1/16" neoprene base pad, when mounted with liquid cyanoacrylate adhesive to steel or plastic surfaces, was virtually unremovable from the mounting surfaces.

Now referring to FIGS. 1, 4, 6 and 7, the security cable used in installing the security system preferably includes a sheath 62 covering the cable, and an end cap 64 having an enlarged head or flange 66 at one end, and a similar end cap at the other end of the cable, with a smaller head (not shown). The rotatable attachment fittings of the security devices are placed through the aperture of the base plate, and the security devices are mounted to the mounting surfaces of the portable equipment, such as the sides of the monitor and desk top computer, and to an anchor surface, such as the side of the table shown in FIG. 1. The end of the cable having the smaller end cap is then threaded through the transverse apertures of the shafts of the rotatable attachment fittings on the portable equipment. The smaller end of the cable at the workstation may then be placed through a lock joint or grommet 68, which has an opening which is just large enough to also thereafter accept a padlock shackle 70, which can then also be inserted through the transverse aperture of the rotatable attachment fitting of the security device on the side of the table or desk at the workstation, as an anchor for the cable security system.

In an alternative embodiment of the security device, as illustrated in FIG. 7, the security device at the other end of the security cable may also include a threaded aperture 72 extending partially through a portion of the first end of the rotatable attachment fitting to intersect with the transverse aperture. The threaded aperture is preferably formed through the first end 34 of the shaft of the attachment fitting along its central, longitudinal axis. A set screw 74 may be inserted and tightened in the set screw aperture to prevent uncontrolled sliding movement of the free end of the security cable within the attachment fitting, such as may occur when the portable equipment is moved at the work station. Alternatively, other types of set screw mountings may also be suitable, such as a set screw collar which fits over the cable and limits movement of the cable by placement adjacent to the attachment fitting or by securing the collar to the attachment fitting.

It will be appreciated that the present invention significantly provides for a rotatable cable attachment fitting which may be mounted on the surface of portable equipment and on an anchor fixture, such as a table or work station, which is convenient to install and which is virtually unremovable once properly installed. The cable attachment fitting is constructed so as to be able to rotate freely in the base plate even when the security device is mounted. The resilient elastomeric base pad and rigid, virtually flex free base plate combine to insure that the security device is not subject to being pried or peeled off. It will be appreciated that the base plate and elastomeric base pad need not be flat, and they may be formed with shapes which would conform to particular mounting surfaces of equipment or anchor fixtures.

It will be apparent from the foregoing that, while particular forms of the invention have been illustrated and described, various modifications can be made without departing from the spirit and scope of the invention. Accordingly, it is not intended that the invention be limited, except as by the appended claims.

I claim:

1. A security device for portable equipment having a mounting surface for attachment of the security device, comprising:

a rigid base plate, having first and second sides and having a shape adapted to generally conform to the mounting surface of the portable equipment, said base plate having an aperture therethrough;

a rotatable cable attachment fitting having a shaft dimensioned such that said attachment fitting is rotatable within said base plate aperture, said shaft having first and second longitudinal ends, with one of said ends being enlarged and having a diameter greater than the diameter of said base plate aperture, said shaft extending through said base plate, with said enlarged end being adjacent to said second side of said base plate;

means for receiving a cable on said attachment fitting, said enlarged shaft end and said cable serving to retain said rotatable attachment fitting within said base plate aperture when said cable is received in said attachment fitting; and a resilient elastomeric base pad having first and second sides, with one side permanently secured to said second side of said base plate, and the other side adapted to generally conform to said surface of said portable equipment and adapted to be adhered to said mounting surface.

2. The security device of claim 1, wherein said aperture through said base plate is generally circular, and said shaft of said attachment fitting is generally cylindrical.

3. The security device of claim 1, wherein said means for receiving said cable comprises a transverse aperture through said shaft of said attachment fitting.

4. The security device of claim 1, wherein said base pad includes an aperture therethrough generally aligned with aid base plate aperture and having a diameter greater than the diameter of said enlarged shaft end.

5. The security device of claim 4, wherein said rotatable attachment fitting includes means for securing said cable so as to prevent sliding movement of said cable within said transverse aperture of said attachment fitting shaft.

6. The security device of claim 5, wherein said means for securing said cable comprises a threaded aperture extending at least partially through a portion of said shaft and intersecting said transverse aperture through said shaft, said threaded aperture being adapted to receive a set screw.

7. The security device of claim 1, wherein said resilient elastomeric base pad is formed of neoprene.

8. A security device for portable equipment having a generally flat surface for attachment of the security device, comprising:

a rigid base plate, having first and second sides and having a generally flat shape adapted to conform to the surface of the portable equipment, said base plate having a generally circular aperture therethrough;

a generally cylindrical security cable attachment fitting having a shaft with a transverse cross-sectional diameter smaller than the diameter of said base plate aperture so as to be rotatable within said base plate aperture, said shaft having first and second longitudinal ends, with one of said ends having a generally circular flange with a diameter greater than the diameter of said base plate aperture, said shaft extending through said base plate, with said flange being adjacent to said second side of said base plate, and said shaft having a transverse aperture therethrough for receiving a security cable; and a resilient elastomeric base pad having first and second sides, with one side permanently secured to said second side of said base plate, and the other side adapted to generally conform to and to be adhered to said surface of said portable equipment.

9. The security device of claim 8, wherein said base pad includes an aperture therethrough generally aligned with said base plate aperture and having a diameter greater than the diameter of said enlarged shaft end.

10. The security device of claim 8, wherein said rotatable attachment fitting includes means for securing said cable within said transverse aperture of said attachment fitting shaft.

11. The security device of claim 10, wherein said means for securing said cable comprises a threaded aperture extending through said shaft and intersecting said transverse aperture through said shaft, said threaded aperture being adapted to receive a set screw.

12. The security device of claim 8, wherein said resilient elastomeric base pad is formed of neoprene.

13. The security device of claim 8, wherein said flange is thinner than said base pad.

* * * * *